US010806268B2

(12) United States Patent
Choi

(10) Patent No.: US 10,806,268 B2
(45) Date of Patent: Oct. 20, 2020

(54) BEDSPREAD AND BEDSTEAD HAVING SAME

(71) Applicant: Inno-Sports Co., Ltd., Xiamen (CN)

(72) Inventor: Kwan Jun Choi, Xiamen (CN)

(73) Assignee: Inno-Sports Co., LTD., Xiamen (CN)

( * ) Notice: Subject to any disclaimer, the term of this patent is extended or adjusted under 35 U.S.C. 154(b) by 281 days.

(21) Appl. No.: 15/807,448

(22) Filed: Nov. 8, 2017

(65) Prior Publication Data

US 2018/0125253 A1 May 10, 2018

(30) Foreign Application Priority Data

Nov. 8, 2016 (CN) ..... 2016 2 1203133 U

(51) Int. Cl.

| | |
|---|---|
| ***A47C 19/02*** | (2006.01) |
| ***A47G 9/02*** | (2006.01) |
| ***A47C 19/12*** | (2006.01) |
| ***A47G 9/04*** | (2006.01) |

(52) U.S. Cl.

CPC ..... *A47C 19/021* (2013.01); *A47C 19/122* (2013.01); *A47G 9/0238* (2013.01); *A47G 9/0292* (2013.01); *A47G 9/04* (2013.01)

(58) Field of Classification Search

CPC ..... A47G 9/04; A47G 9/0292; A47G 9/0238; A47G 9/0246; A47C 19/021; A47C 19/122; A47C 21/02; A47C 21/021; A47C 21/022; A47C 21/028; A47C 21/024; Y10T 24/23

See application file for complete search history.

(56) References Cited

U.S. PATENT DOCUMENTS

| | | | | |
|---|---|---|---|---|
| 202,685 A | | 4/1878 | White | |
| 324,843 A | | 8/1885 | Horton | |
| 337,415 A | | 3/1886 | McKeough | |
| 893,364 A | | 7/1908 | Piaser | |
| 1,196,253 A | | 8/1916 | Lovvy | |
| 4,773,108 A | * | 9/1988 | Leever | A47C 21/022 24/72.5 |

(Continued)

FOREIGN PATENT DOCUMENTS

| | | |
|---|---|---|
| CN | 204336376 U | 5/2015 |
| CN | 204336377 U | 5/2015 |
| GB | 810195 A | 3/1959 |

OTHER PUBLICATIONS

U.S. Appl. No. 15/144,597, filed May 2, 2016.

(Continued)

*Primary Examiner* — Robert G Santos
*Assistant Examiner* — Alison N Labarge
(74) *Attorney, Agent, or Firm* — Morgan, Lewis & Bockius LLP

(57) ABSTRACT

Disclosed are couplers, bedspreads and bedsteads. A bedspread includes a bed cloth, a bed drape and a plurality of couplers. The bed cloth has a peripheral edge corresponding to an upper peripheral frame of a bedframe. The bed drape is coupled or integrally formed with the bed cloth along the peripheral edge, and hangs down when in use. Each coupler includes a plate, a hook, and an elastic strap connecting the plate with the hook. The plate is disposed on an interior side of the bed cloth at or proximal to the peripheral edge of the bed cloth. The hook is configured to couple with a lower support of the bedframe.

18 Claims, 3 Drawing Sheets

(56) References Cited

U.S. PATENT DOCUMENTS

| | | | | |
|---|---|---|---|---|
| 6,062,589 | A | 5/2000 | Cheng | |
| 6,223,628 | B1 | 5/2001 | Barron | |
| 6,575,656 | B2 | 6/2003 | Suh | |
| 6,938,927 | B1 | 9/2005 | Martin | |
| 7,066,676 | B2 | 6/2006 | Tsai | |
| 7,144,078 | B2 | 12/2006 | Hsieh | |
| 7,849,867 | B2 | 12/2010 | Takayama | |
| 7,874,303 | B2 | 1/2011 | Xie | |
| 8,806,677 | B1 | 8/2014 | Bartelsmeyer | |
| 8,856,984 | B1 * | 10/2014 | Donham | A47G 9/0246 5/496 |
| 8,888,123 | B1 | 11/2014 | Cheng | |
| 9,027,952 | B2 | 5/2015 | Zhu | |
| 9,107,509 | B2 * | 8/2015 | Lee | A47C 19/022 |
| 9,248,072 | B2 | 2/2016 | Wu | |
| 9,254,046 | B1 * | 2/2016 | Arenstein | A47C 21/022 |
| 9,456,698 | B2 | 10/2016 | Oh | |
| 9,895,003 | B2 | 2/2018 | Choi | |
| 10,123,629 | B2 | 11/2018 | Choi | |
| 10,125,801 | B2 | 11/2018 | Wilson | |
| 10,285,506 | B2 | 5/2019 | Choi | |
| 2006/0062632 | A1 | 3/2006 | Jang | |
| 2007/0012346 | A1 | 1/2007 | Choi | |
| 2011/0099712 | A1 | 5/2011 | Jin | |
| 2012/0222216 | A1 | 9/2012 | Jin | |
| 2013/0067659 | A1 * | 3/2013 | Oh | A47C 19/12 5/400 |
| 2013/0276228 | A1 | 10/2013 | Hsieh | |
| 2015/0320225 | A1 | 11/2015 | Boyd | |
| 2015/0327684 | A1 | 11/2015 | Lee | |
| 2016/0157620 | A1 | 6/2016 | Oh | |
| 2018/0110339 | A1 | 4/2018 | Moon | |
| 2018/0192778 | A1 | 7/2018 | Choi | |
| 2018/0271296 | A1 | 9/2018 | Harrow | |
| 2018/0332973 | A1 | 11/2018 | Choi | |
| 2019/0029435 | A1 | 1/2019 | Choi | |
| 2019/0045938 | A1 | 2/2019 | Skaggs | |

OTHER PUBLICATIONS

U.S. Appl. No. 15/389,298, filed Dec. 22, 2016.
U.S. Appl. No. 15/400,861, filed Jan. 6, 2017.
U.S. Appl. No. 15/600,581, filed May 19, 2017.
U.S. Appl. No. 15/423,055, filed Feb. 2, 2017, now U.S. Pat. No. 9,895,003.
U.S. Appl. No. 15/423,161, filed Feb. 2, 2017.
U.S. Appl. No. 15/949,542, filed Apr. 5, 2018.

* cited by examiner

BEDSPREAD AND BEDSTEAD HAVING SAME

CROSS-REFERENCE TO RELATED APPLICATIONS

The present application claims priority to Chinese Utility Model Application CN 201621203133.X filed Nov. 8, 2016. The disclosure of the application is incorporated herein for all purposes by reference in its entirety.

FIELD OF THE INVENTION

The present invention generally relates to bedsteads, and more particularly, relates to bedspreads and bedsteads having such bedspreads.

BACKGROUND

Bedsteads with metal bedframes, in particular with metal foldable bedframes, are now widely used in Europe and America. Such a bedstead usually includes a metal bedframe and a bedspread covering the metal bedframe. In the existing design, a bedspread is simply laid over a bedframe, with the edge or the drape of the bedspread hanging down freely. As such, it is difficult to align the bedspread with the bedframe, and in many cases, completion of the alignment requires one going back and forth multiple times. Moreover, it is difficult to make and maintain the peripheral corners of the bedspread even and flat. Further, without any support, the edge or the drape of the bedspread may wrinkle, waver or fold, exposing underneath parts and thus adversely affecting the aesthetic appearance of the bedstead.

Given the current state of the art, there remains a need for couplers, bedspreads and bedsteads that address the above-mentioned issues.

The information disclosed in this Background section is provided for an understanding of the general background of the invention and is not an acknowledgement or suggestion that this information forms part of the prior art already known to a person skilled in the art.

SUMMARY OF THE INVENTION

The present invention provides couplers, bedspreads and bedsteads. The bedspreads of the present invention are easy to setup, and are tight and smooth when in use.

In various exemplary embodiments, the present invention provides a coupler of a bedspread including a plate, a hook, and an elastic strap having a first end portion coupled with the plate and a second end portion coupled with the hook. The plate is configured to be disposed on an interior side of a bed cloth of the bedstead at or proximal to a peripheral edge of the bed cloth. In some exemplary embodiments, the plate has a side edge fitting with the peripheral edge of the bed cloth.

The hook is configured to couple with a lower support of a bedframe. In many exemplary embodiments, the hook includes a bottom, a first side wall and one or more barbs. The first side wall is integrally formed with the bottom at the first side of the bottom, and one or more barbs are integrally formed with the bottom at the second side of the bottom. A groove is formed between the first side wall and the one or more barbs to receive the lower support of the bedframe. In some exemplary embodiments, the first side wall is formed with a slot to couple with the second end portion of the elastic strap. In an exemplary embodiment, the elastic strap has a width narrower than a width of the first side wall of the hook.

In various exemplary embodiments, the present invention provides a bedspread including a bed cloth, a bed drape, and a plurality of couplers. The bed cloth has a peripheral edge corresponding to an upper peripheral frame of a bedframe. The bed drape is coupled or integrally formed with the bed cloth along the peripheral edge of the bed cloth. The bed drape hangs down when the bedspread is in use. Each coupler includes a plate, a hook and an elastic strap having a first end portion coupled with the plate and a second end portion coupled with the hook. The plate is disposed on an interior side of the bed cloth at or proximal to the peripheral edge of the bed cloth. The hook is configured to couple with a lower support of the bedframe.

In many exemplary embodiments, the bed cloth includes a plurality of corners, and each respective corner in the plurality of corners has a corresponding coupler in the plurality of couplers disposed thereat. In some exemplary embodiments, the plate of the corresponding coupler has a substantially "L" shape, and includes a side edge fitting with the peripheral edge of the bed cloth at the respective corner.

In some exemplary embodiments, the hook of the corresponding coupler is curved to fit with the lower support of the bedframe at a corner of the lower support. The hook includes a bottom, a first side wall and one or more barbs. The first side wall is integrally formed with the bottom at the first side of the bottom, and one or more barbs are integrally formed with the bottom at the second side of the bottom. A groove is formed between the first side wall and the one or more barbs to receive and couple with the lower support of the bedframe.

In various exemplary embodiments, the present invention provides a bedstead including a bedframe and a bedspread coupled with the bedframe when in use. The bedframe includes an upper peripheral frame and a lower support.

The bedspread includes a bed cloth, a bed drape, and a plurality of couplers. The bed cloth has a peripheral edge corresponding to the upper peripheral frame of the bedframe. The bed drape is coupled or integrally formed with the bed cloth along the peripheral edge of the bed cloth. The bed drape hangs down when the bedspread is in use. Each coupler includes a plate, a hook and an elastic strap having a first end portion coupled with the plate and a second end portion coupled with the hook. The plate is disposed on an interior side of the bed cloth at or proximal to the peripheral edge of the bed cloth. The hook is configured to couple with the lower support of the bedframe.

In some exemplary embodiments, the bedframe includes a first sub-frame and a second sub-frame pivotally connected to each other.

In many exemplary embodiments, when the bedstead is in use, the plate of each coupler in the plurality of couplers is placed on the upper peripheral frame of the bedframe.

In some exemplary embodiments, the lower support has a substantially "U" shape. In an exemplary embodiment, the lower support is disposed directly below the upper peripheral frame of the bedframe when the bedstead is in use.

In some exemplary embodiments, the bedframe includes a plurality of legs, and the lower support is coupled with one or more legs in the plurality of legs. In some exemplary embodiments, the lower support is coupled with the upper peripheral frame and with one or more legs in the plurality of legs.

In many exemplary embodiments, the bed cloth includes a plurality of corners, and each respective corner in the plurality of corners has a corresponding coupler in the plurality of couplers disposed thereat. In some exemplary embodiments, the plate of the corresponding coupler has a substantially "L" shape, and includes a side edge fitting with the peripheral edge of the bed cloth at the respective corner. In some exemplary embodiments, the hook of the corresponding coupler is curved to fit with the lower support of the bedframe at a corner of the lower support. The hook includes a bottom, a first side wall and one or more barbs. The first side wall is integrally formed with the bottom at the first side of the bottom, and one or more barbs are integrally formed with the bottom at the second side of the bottom. A groove is formed between the first side wall and the one or more barbs to receive and couple with the lower support of the bedframe. In an exemplary embodiment, the first side wall of the hook is formed with a slot to couple with the second end portion of the elastic strap.

The couplers, bedspreads and bedsteads of the present invention have other features and advantages that will be apparent from, or are set forth in more detail in, the accompanying drawings, which are incorporated herein, and the following Detailed Description, which together serve to explain certain principles of exemplary embodiments of the present invention.

BRIEF DESCRIPTION OF THE DRAWINGS

The accompanying drawings, which are incorporated into and constitute a part of this specification, illustrate one or more exemplary embodiments of the present invention and, together with the Detailed Description, serve to explain the principles and implementations of exemplary embodiments of the invention.

In the figures, reference numbers refer to the same or equivalent parts of the present invention throughout the several figures of the drawing.

DETAILED DESCRIPTION

Figure 1:
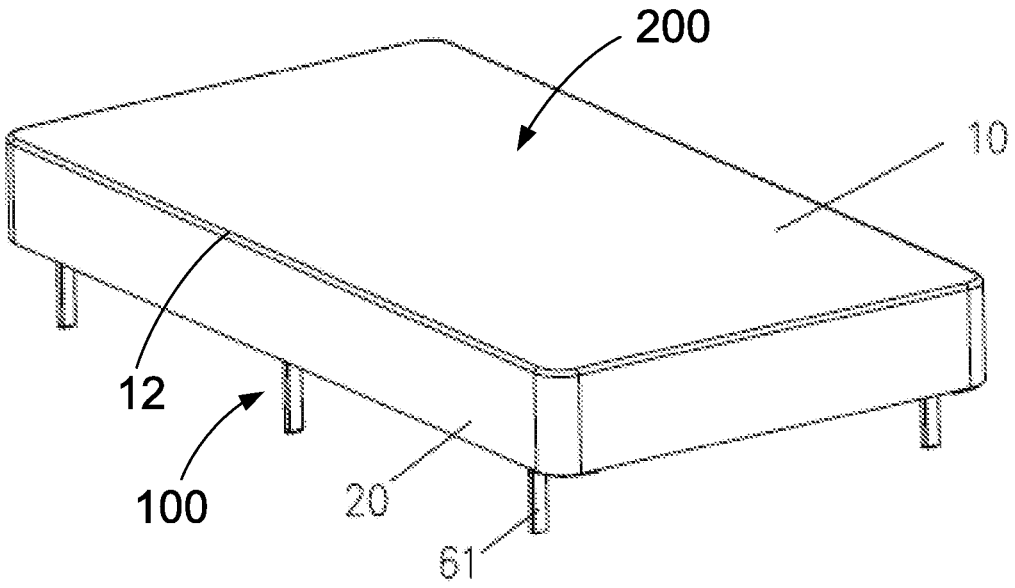
FIG. 1 is a schematic view illustrating an exemplary bedstead in accordance with some exemplary embodiments of the present invention.

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

In the interest of clarity, not all of the routine features of the implementations described herein are shown and described. It will be appreciated that, in the development of any such actual implementation, numerous implementation-specific decisions are made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Many modifications and variations of the exemplary embodiments set forth in this disclosure can be made without departing from the spirit and scope of the embodiments, as will be apparent to those skilled in the art. The specific exemplary embodiments described herein are offered by way of example only, and the disclosure is to be limited only by the terms of the appended claims, along with the full scope of equivalents to which such claims are entitled.

Embodiments of the present invention are described in the context of bedspreads and bedsteads. A bedspread of the present invention generally includes a bed cloth and a plurality of couplers disposed on the bed cloth. The plurality of couplers is configured to couple the bed cloth with a bedframe and to maintain the bed cloth straight, tight and/or smooth. In some cases in which the bedspread includes additional/optional components such as bed drapes, the plurality of couplers also helps to maintain these additional/optional components straight, tight and/or smooth, and thus improves the aesthetic appearance of a bed. In many cases, the couplers are disposed in the interior side of the bedspread such that when in use, the couplers are not visible from the outside, and thus further improve the appearance of the bed.

A bedstead of the present invention includes a bedframe and a bedspread configured to couple with the bedframe. The bedframe can be foldable or non-foldable. It can be of various sizes including but not limited to twin, full, queen and king sizes, and of various shapes including but not limited to rectangles and squares. It can be made of various materials including but not limited to metals such as steel, plastics and woods.

Referring to FIG. 1, there is depicted an exemplary bedstead in accordance with some embodiments of the present invention. The bedstead includes a bedframe such as bedframe 100 and a bedspread such as bedspread 200 coupled to and supported by the bedframe.

Figure 2:
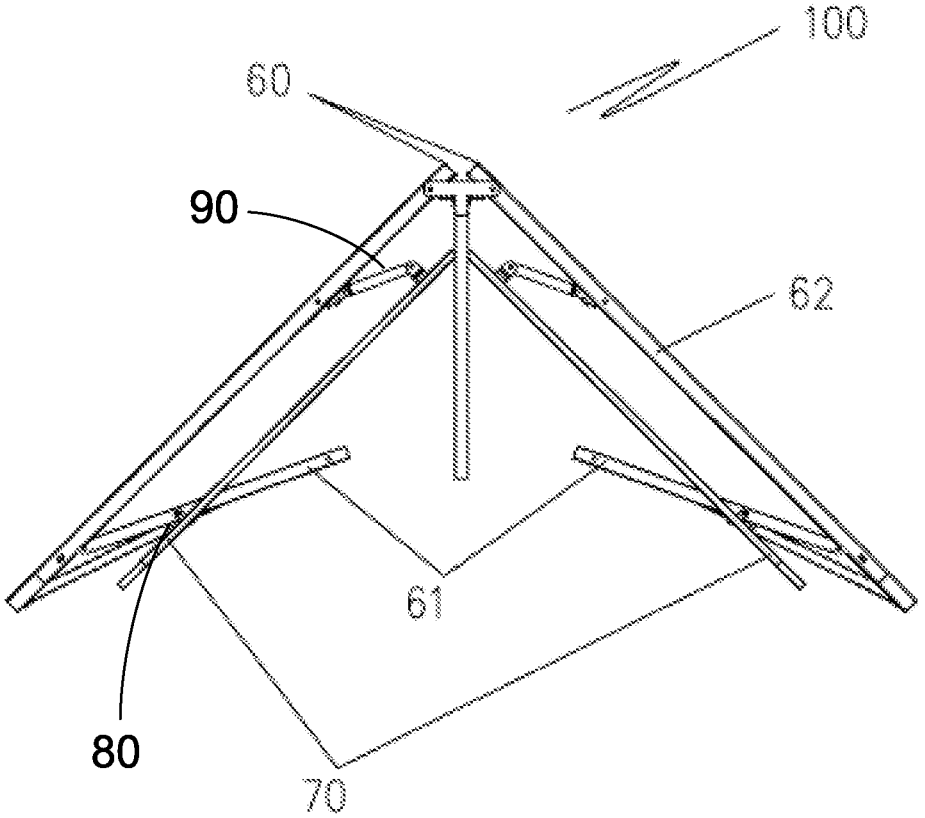
FIG. 2 is a schematic view illustrating an exemplary bedframe in accordance with some exemplary embodiments of the present invention.

The bedframe can be foldable or non-foldable. By way of example, FIG. 2 illustrates a foldable bedframe. In the illustrated embodiment, bedframe 100 includes first and second sub-frames 60 pivotally connected to each other at their proximal sides. Sub-frame 60 includes upper frame 62, legs 61 and lower support 70. When unfolded, upper frames 62 of the first and second sub-frames collectively form an upper peripheral frame (e.g., a peripheral edge) of bedframe 100. In some embodiments, the upper peripheral frame of bedframe 100 has a substantially rectangular shape with four corners.

In some embodiments, lower support 70 is coupled with one or more legs 61, for instance, by link 80 or the like. In an embodiment, lower support 70 is fixedly coupled with one or more legs 61. In some embodiments, lower support 70 is also coupled with upper frame 62, for instance, by link 90 or the like. In some embodiments, lower support 70 has a "U" shape corresponding to upper frame 62 or a portion of upper frame 62. When in use, lower support 70 is typically disposed directly below upper frame 62 (e.g., lower support 70 is vertically aligned with upper frame 62).

In many embodiments, bedspread 200 includes bed cloth 10 with peripheral edge 12, which generally corresponds to the upper peripheral frame of the bedframe. In some embodiments, bedspread 200 also includes bed drape 20 coupled (e.g., stitched) or integrally formed with the bed cloth along the peripheral edge of the bed cloth. When bedspread 200 is coupled with the bedframe, the bed cloth usually rests flat on the bedframe while the bed drape hangs down from the peripheral edge of the bed cloth.

In various embodiments, bedspread 200 further includes a plurality of couplers configured to couple the bedspread with the bedframe. A coupler generally includes a plate disposed on the bed cloth, a hook to couple with the bedframe, and an elastic strap connecting the plate and the hook. A bedspread can includes couplers disposed along the peripheral edge of the bed cloth at any suitable positions, e.g., at a lateral portion, a longitudinal portion, and/or a corner of the peripheral edge of the bed cloth.

Figure 3:
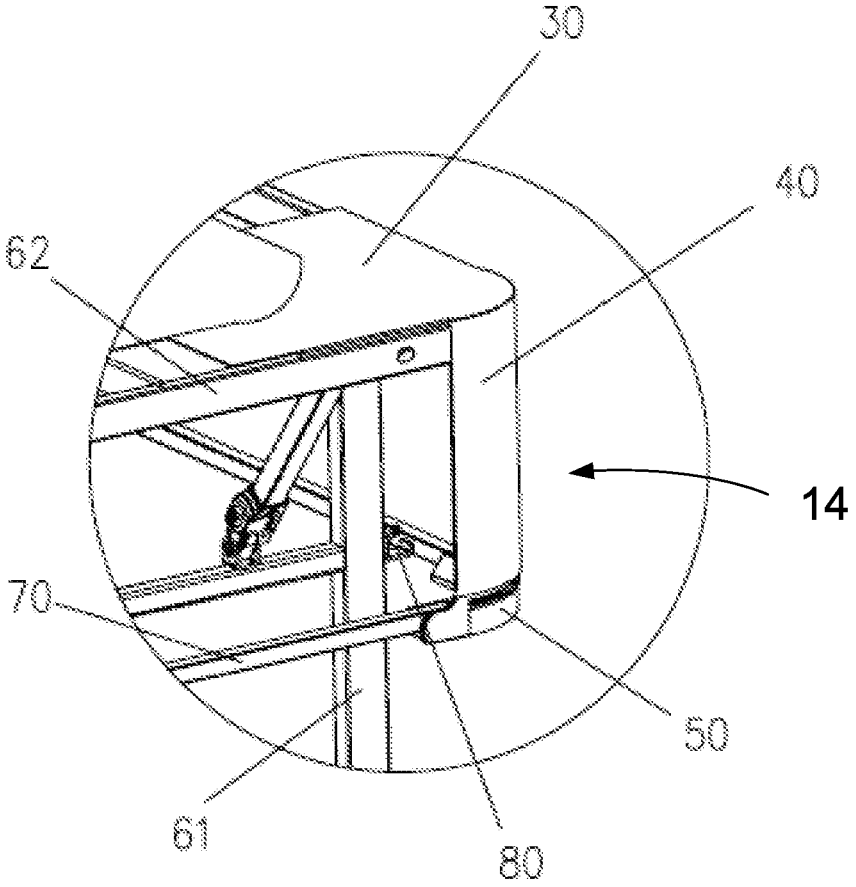
FIG. 3 is a schematic view illustrating an exemplary coupler on a bedframe in accordance with some exemplary embodiments of the present invention.

By way of example, FIG. 3 illustrates a coupler disposed at a corner of the peripheral edge of the bed cloth (for illustration clarity, the bed cloth is not shown in FIG. 3) and coupled with the corresponding corner of the bedframe. Coupler 14 includes plate 30, elastic strap 40 and hook 50. Plate 30 is disposed on an interior side of the bed cloth at or proximal to the peripheral edge of the bed cloth. The interior side of the bed cloth as used herein refers to the lower side of the bed cloth in FIG. 1 that faces downward and is not visible from the top.

Figure 4:
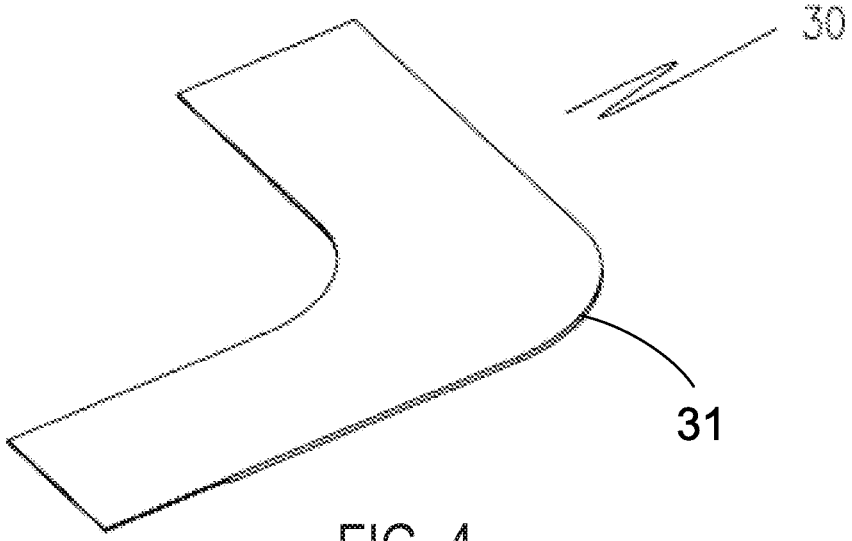
FIG. 4 is a schematic view illustrating an exemplary plate of the coupler of FIG. 3.
Figure 5:
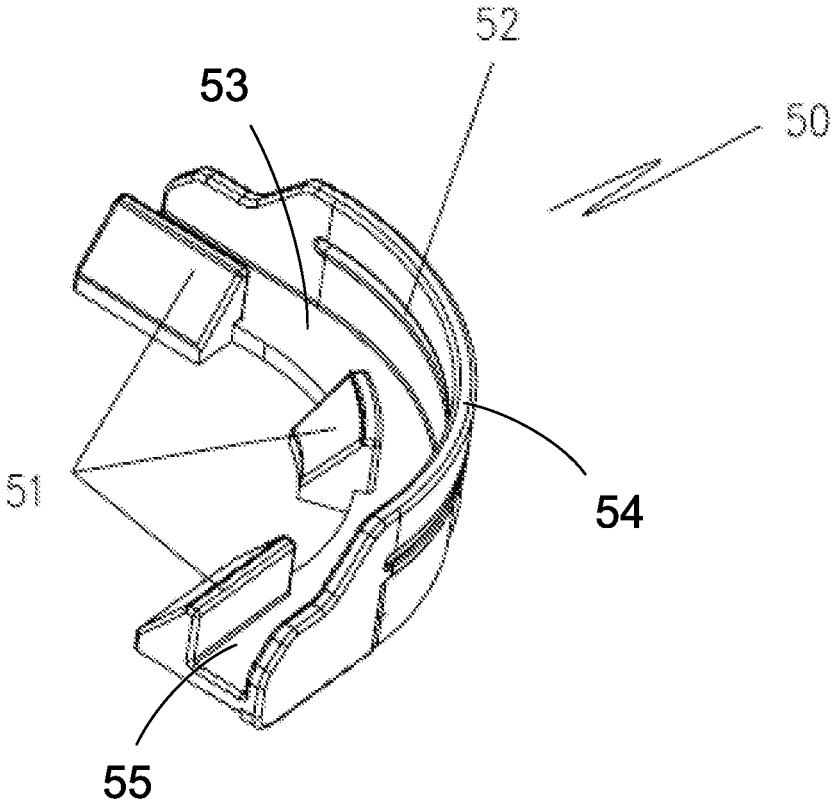
FIG. 5 is a schematic view illustrating an exemplary hook of the coupler of FIG. 3.

In some embodiments, plate 30 has a side edge fitting with the peripheral edge of the bed cloth (e.g., the shape or curvature of the side edge matching locally a portion of the peripheral edge of the bed cloth). For instance, in some embodiments such as those illustrated in FIGS. 3-5, plate 30 has a substantially "L" shape, and includes side edge 31 fitting with the corner of the peripheral edge of the bed cloth. In an embodiment, the corner of the peripheral edge of the bed cloth and the "L"-shaped plate is rounded.

Hook 50 is configured to couple (e.g., removably couple) with the lower support (e.g., lower support 70) of the bedframe. In some embodiments, hook 50 includes bottom 53 having a first side and a second side. First side wall 54 is integrally formed at the first side and one or more barbs 51 (e.g., protrusions) are integrally formed at the second side of the bottom. Groove 55 is formed between the first side wall and the one or more barbs to receive the lower support of the bedframe. In an embodiment, a plurality of barbs 51 (e.g., three in FIG. 5) is uniformly distributed along the second side of the bottom.

In some embodiments, first side wall 54 is formed with slot 52 to couple with the second end portion of the elastic strap. In an embodiment, the slot is formed along the width direction of the first side wall. In an embodiment, the elastic strap has a width narrower than a width of the first side wall.

In many embodiments, the first side wall of the hook is aligned with a peripheral edge (e.g., the outer edge of the lower support) of the bedframe. For instance, in some embodiments such as those illustrated in FIGS. 3-5, the hook is curved to fit with the lower support of the bedframe at the corresponding corner.

Elastic strap 40 connects the plate with the hook. For instance, in some embodiments, elastic strap 40 has a first end portion coupled with the plate and a second end portion coupled with the hook. When in use, elastic strap 40 helps to support, straighten, tighten or flatten the bed drape.

In some embodiments, the upper peripheral frame of bedframe 100 has a substantially rectangular shape with four corners. Corresponding to the upper peripheral frame of bedframe 100, the peripheral edge of bed cloth 10 also has a substantially rectangular shape with four corners. A coupler is disposed at each corner, for instance, by stitching or gluing the plate of the coupler at each corner of the bed cloth. In some embodiments, the plate has a substantially "L" shape, and the hook is curved. The elastic strap connecting the plate and the hook is also curved, assuming the corner profile of the bedframe as illustrated in FIG. 3.

With the couplers of the present invention, setting up the bedspread on the bedframe is simple and easy. First, lay the bedspread over the bedframe with the plates of the couplers at appropriate positions. For instance, in embodiments with a coupler at each of the four corners of the bed cloth, simply place the couplers at the four corners of the bedframe. Then pull the elastic strap and snap the hook of each coupler onto the lower support of the bedframe. Afterward, let the bed drape hanging down.

When coupled with the bedframe, the entire bedspread is neat and tight. For instance, the bed cloth of the bedspread, secured by the plates of the couplers, is smooth and flat. The bed drape of the bedspread, supported by the straps and the first side walls of the hooks, is tight and straight.

The terminology used herein is for the purpose of describing particular implementations only and is not intended to be limiting of the claims. As used in the description of the implementations and the appended claims, the singular forms "a", "an" and "the" are intended to include the plural forms as well, unless the context clearly indicates otherwise. The term "and/or" refers to and encompasses any and all possible combinations of one or more of the associated listed items. The terms "comprises" and or "comprising," when used in this specification, specify the presence of stated features, integers, steps, operations, elements, and or components, but do not preclude the presence or addition of one or more other features, integers, steps, operations, elements, components, and/or groups thereof. It will be understood that the terms "upper", "lower", and etc. are used to describe features of the exemplary embodiments with reference to the positions of such features as displayed in the figures. It will be understood that, although the terms "first," "second," etc. may be used herein to describe various elements, these elements should not be limited by these terms. These terms are only used to distinguish one element from another. For example, a first sub-frame could be termed a second sub-frame, and, similarly, a second sub-frame could be termed a first sub-frame, without changing the meaning of the description, so long as all occurrences of the "first sub-frame" are renamed consistently and all occurrences of the "second sub-frame" are renamed consistently.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various alternatives and modifications thereof. It is intended that the scope of the invention be defined by the Claims appended hereto and their equivalents.

What is claimed is:

1. A coupler of a bedspread for coupling the bedspread with a bedframe, wherein the bedframe comprises an upper peripheral frame and a lower support, and wherein the bedspread comprises a bed cloth having a peripheral edge corresponding to the upper peripheral frame of the bedframe, and a bed drape coupled or integrally formed with the bed cloth along the peripheral edge, and hanging down when in use, the coupler comprising:

a plate having a first side to be disposed on an interior side of the bed cloth of the bedstead at or proximal to the peripheral edge of the bed cloth, and a second side to be disposed on the upper peripheral frame of the bedframe, wherein the plate comprises a side edge fitting with a corner of the peripheral edge of the bed cloth;

a hook comprising:

a groove to receive the lower support of the bedframe, thereby coupling with the lower support of the bedframe; and a first side wall disposed substantially perpendicular to the plate when the groove receives the lower support of the bedframe, and curved to fit with the lower support of the bedframe at a corresponding corner of the bedframe; and an elastic strap having a first end portion coupled with the plate at or proximal to the side edge of the plate and a second end portion coupled with the first side wall of the hook, thereby allowing the elastic strap to hold the bed drape taut at the corner of the bedspread.

2. The coupler of claim 1, wherein the hook comprises:

a bottom having a first side and a second side;

the first side wall integrally formed with the bottom at the first side thereof; and one or more barbs integrally formed with the bottom at the second side thereof, wherein the groove is formed between the first side wall and the one or more barbs to receive the lower support of the bedframe.

3. The coupler of claim 2, wherein the first side wall is formed with a slot to couple with the second end portion of the elastic strap.

4. The coupler of claim 2, wherein the elastic strap has a width narrower than a width of the first side wall of the hook.

5. A bedspread for using at a bedframe having an upper peripheral frame and a lower support, the bedspread comprising:

a bed cloth having a peripheral edge corresponding to the upper peripheral frame of the bedframe;

a bed drape coupled or integrally formed with the bed cloth along the peripheral edge thereof, wherein the bed drape hangs down when in use; and a plurality of couplers, each comprising:

a plate having a first side disposed on an interior side of the bed cloth at or proximal to the peripheral edge of the bed cloth, and a second side to be disposed on the upper peripheral frame of the bedframe, wherein the plate comprises a side edge fitting with a corner of the peripheral edge of the bed cloth;

a hook comprising:

a groove to receive the lower support of the bedframe, thereby coupling with the lower support of the bedframe; and a first side wall disposed substantially perpendicular to the plate when the groove receives the lower support of the bedframe, and curved to fit with the lower support of the bedframe at a corresponding corner of the bedframe; and an elastic strap having a first end portion coupled with the plate at or proximal to the side edge of the plate and a second end portion coupled with the first side wall of the hook, thereby allowing the elastic strap to hold the bed drape taut at the corner of the bedspread.

6. The bedspread of claim 5, wherein the bed cloth comprises a plurality of corners, and each respective corner in the plurality of corners has a corresponding coupler in the plurality of couplers disposed thereat.

7. The bedspread of claim 6, wherein the plate of the corresponding coupler has a substantially "L" shape, and comprises the side edge fitting with the peripheral edge of the bed cloth at the respective corner.

8. The bedspread of claim 6, wherein the hook of the corresponding coupler comprises:

a bottom having the first side and second side;

the first side wall integrally formed with the bottom at the first side thereof; and one or more barbs integrally formed with the bottom at the second side thereof, wherein the groove is formed between the first side wall and the one or more barbs to receive and couple with the lower support of the bedframe.

9. A bedstead comprising:

a bedframe comprising an upper peripheral frame and a lower support; and a bedspread coupled with the bedframe when in use, wherein the bedspread comprises:

a bed cloth comprising a peripheral edge corresponding to the upper peripheral frame of the bedframe;

a bed drape coupled or integrally formed with the bed cloth along the peripheral edge thereof, wherein the bed drape hangs down when in use; and a plurality of couplers, each comprising:

a plate having a first side coupled with an interior side of the bed cloth at or proximal to the peripheral edge of the bed cloth, and a second side to be disposed on the upper peripheral frame of the bedframe, wherein the plate comprises a side edge fitting with a corner of the peripheral edge of the bed cloth;

a hook comprising:

a groove to receive the lower support of the bedframe, thereby coupling with the lower support of the bedframe; and a first side wall disposed substantially perpendicular to the plate when the groove receives the lower support of the bedframe, and curved to fit with the lower support of the bedframe at a corresponding corner of the bedframe; and an elastic strap having a first end portion coupled with the plate at or proximal to the side edge of the plate and a second end portion coupled with the first side wall of the hook, thereby allowing the elastic strap to hold the bed drape taut at the corner of the bedspread.

10. The bedstead of claim 9, wherein the bedframe comprises a first sub-frame and a second sub-frame pivotally connected to each other, wherein each of the first and second sub-frames comprises an upper peripheral sub-frame and a lower sub-support;

the upper peripheral sub-frames of the first and second sub-frames collectively form the upper peripheral frame of the bedframe; and the lower sub-supports of the first and second sub-frames collectively form the lower support of the bedframe.

11. The bedstead of claim 9, wherein the lower support has a substantially "U" shape.

12. The bedstead of claim 9, wherein when in use, the lower support is disposed directly below the upper peripheral frame of the bedframe.

13. The bedstead of claim 9, wherein the bedframe comprises a plurality of legs, and the lower support is coupled with one or more legs in the plurality of legs.

14. The bedstead of claim 9, wherein the bedframe comprises a plurality of legs, and the lower support is coupled with the upper peripheral frame and with one or more legs in the plurality of legs.

15. The bedstead of claim 9, wherein the bed cloth comprises a plurality of corners, and each respective corner in the plurality of corners has a corresponding coupler in the plurality of couplers disposed thereat.

16. The bedstead of claim 15, wherein the plate of the coupler has a substantially "L" shape, and comprises the side edge fitting with the peripheral edge of the bed cloth at the respective corner.

17. The bedstead of claim 15, wherein the hook of the coupler comprises:

a bottom having the first side and second side;

the first side wall integrally formed with the bottom at the first side thereof; and one or more barbs integrally formed with the bottom at the second side thereof, wherein the groove is formed between the first side wall and the one or more barbs to receive and couple with the lower support of the bedframe, and the hook is curved to fit with the lower support of the bedframe at a corner thereof.

18. The bedstead of claim 17, wherein the first side wall of the hook is formed with a slot to couple with the second end portion of the elastic strap.

* * * * *